US011525343B2

(12) United States Patent
Urban et al.

(10) Patent No.: US 11,525,343 B2
(45) Date of Patent: Dec. 13, 2022

(54) OPEN TIP DOWNHOLE EXPANSION TOOL

(71) Applicants: Larry Urban, Santa Fe, TX (US); Gary Anderson, Dublin, OH (US); Tyler Shirk, Houston, TX (US); Tanner Welch, Houston, TX (US)

(72) Inventors: Larry Urban, Santa Fe, TX (US); Gary Anderson, Dublin, OH (US); Tyler Shirk, Houston, TX (US); Tanner Welch, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/132,618

(22) Filed: Dec. 23, 2020

(65) Prior Publication Data

US 2022/0195849 A1 Jun. 23, 2022

(51) Int. Cl.
*E21B 33/126* (2006.01)
*E21B 43/10* (2006.01)

(52) U.S. Cl.
CPC ..... *E21B 43/106* (2013.01)

(58) Field of Classification Search
CPC ..... E21B 33/126
See application file for complete search history.

(56) References Cited

U.S. PATENT DOCUMENTS 49,783 A * 9/1865 Parham ..... E21B 33/126 277/335
3,346,267 A * 10/1967 Farley ..... E21B 37/10 277/335
4,162,079 A * 7/1979 Jelinek ..... E21B 33/126 277/335
6,896,049 B2 5/2005 Moyes
(Continued)

FOREIGN PATENT DOCUMENTS

EP 1408195 B1 4/2004
WO 2019051468 A1 3/2019

OTHER PUBLICATIONS

Notification of Transmittal of the International Search Report and the Written Opinion of the International Searching Authority, or the Declaration; PCT/US2021-073010; dated Apr. 1, 2022: 10 pages.
(Continued)

*Primary Examiner* — Kipp C Wallace
(74) *Attorney, Agent, or Firm* — Cantor Colburn LLP

(57) ABSTRACT

An open tip downhole expansion tool including a frustoconical member having a base at a diametrically smaller portion of the frustoconical member and a tip at a diametrically larger portion of the frustoconical member, the member having a radially outer zone and a radially inner zone and having an axial length extending from the base to the tip; an outer void in a material of the member along a length of the radially outer zone; and an inner void in a material of the member along a length of the radially inner zone, the outer and inner voids being located at different positions along the
(Continued)

axial length of the frustoconical member, the outer and inner voids each causing the frustoconical member to present a first resistance to deformation when the voids are open and a higher resistance to deformation of the frustoconical member when the voids are collapsed.

10 Claims, 6 Drawing Sheets

(56) References Cited

U.S. PATENT DOCUMENTS

| | | | | |
|---|---|---|---|---|
| 8,151,894 | B2 | 4/2012 | Nutley et al. | |
| 9,228,411 | B2 | 1/2016 | Themig | |
| 9,732,581 | B2 | 8/2017 | Morehead | |
| 9,784,066 | B1 | 10/2017 | Branton et al. | |
| 10,443,343 | B2 | 10/2019 | Doane et al. | |
| 2005/0023003 | A1* | 2/2005 | Echols | E21B 33/127 166/384 |
| 2006/0219415 | A1 | 10/2006 | Xu | |
| 2008/0296845 | A1* | 12/2008 | Doane | E21B 33/1208 277/337 |
| 2009/0277648 | A1 | 11/2009 | Nutley et al. | |
| 2010/0263857 | A1 | 10/2010 | Frazier | |
| 2012/0055667 | A1 | 3/2012 | Ingram et al. | |
| 2012/0217025 | A1 | 8/2012 | Shkurti et al. | |
| 2013/0147121 | A1 | 6/2013 | Xu | |
| 2014/0290946 | A1 | 10/2014 | Nguyen et al. | |
| 2016/0097252 | A1* | 4/2016 | Resink | E21B 33/126 166/387 |
| 2018/0172160 | A1 | 6/2018 | Urban et al. | |
| 2019/0040710 | A1 | 2/2019 | Deng et al. | |
| 2019/0249511 | A1 | 8/2019 | Deng et al. | |
| 2019/0368304 | A1 | 12/2019 | Deng et al. | |
| 2022/0195829 | A1 | 6/2022 | Urban et al. | |

OTHER PUBLICATIONS

Yablon, Dalia, Confustion of moduli, Nov. 16, 2017, Wiley Analytical Science, Available from: https://analyticalscience.wiley.com/do/10.1002/micro.2417/full/ (Year: 2017).

Notification of Transmittal of the International Search Report and the Written Opinion of the International Searching Authority, or the Declaration; PCT/US2021/073011; dated Apr. 15, 2022: 10 pages.

* cited by examiner

OPEN TIP DOWNHOLE EXPANSION TOOL

BACKGROUND

In the resource recovery industry there is often reason to expand diametrically a tool. This may be to support a tubular or span an annulus, for example. One common tool that is frequently used will be characterized herein as an open tip downhole expansion tool. While there are a number of tools that fit within this characterization, one of them is a backup for an element of a seal. Such tools are deflected from a run in position to a deployed position based upon pressure in the element from inflation or compression thereof, for example. There are competing interests with respect to such tools. These are ease of setting and durability of holding once set. The simplest recitation of this is a thinner material tool will set easily but also fail easily and a thicker material tool will be difficult to set but will likely not fail once set. It is important to the art to manage these competing interests.

In view of the above, the art will benefit from a new configuration for an open tip downhole expansion tool.

SUMMARY

An embodiment of an open tip downhole expansion tool including a frustoconical member having a base at a diametrically smaller portion of the frustoconical member and a tip at a diametrically larger portion of the frustoconical member, the member having a radially outer zone and a radially inner zone and having an axial length extending from the base to the tip; an outer void in a material of the member along a length of the radially outer zone; and an inner void in a material of the member along a length of the radially inner zone, the outer and inner voids being located at different positions along the axial length of the frustoconical member, the outer and inner voids each causing the frustoconical member to present a first resistance to deformation when the voids are open and a higher resistance to deformation of the frustoconical member when the voids are collapsed.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

Figure 1:
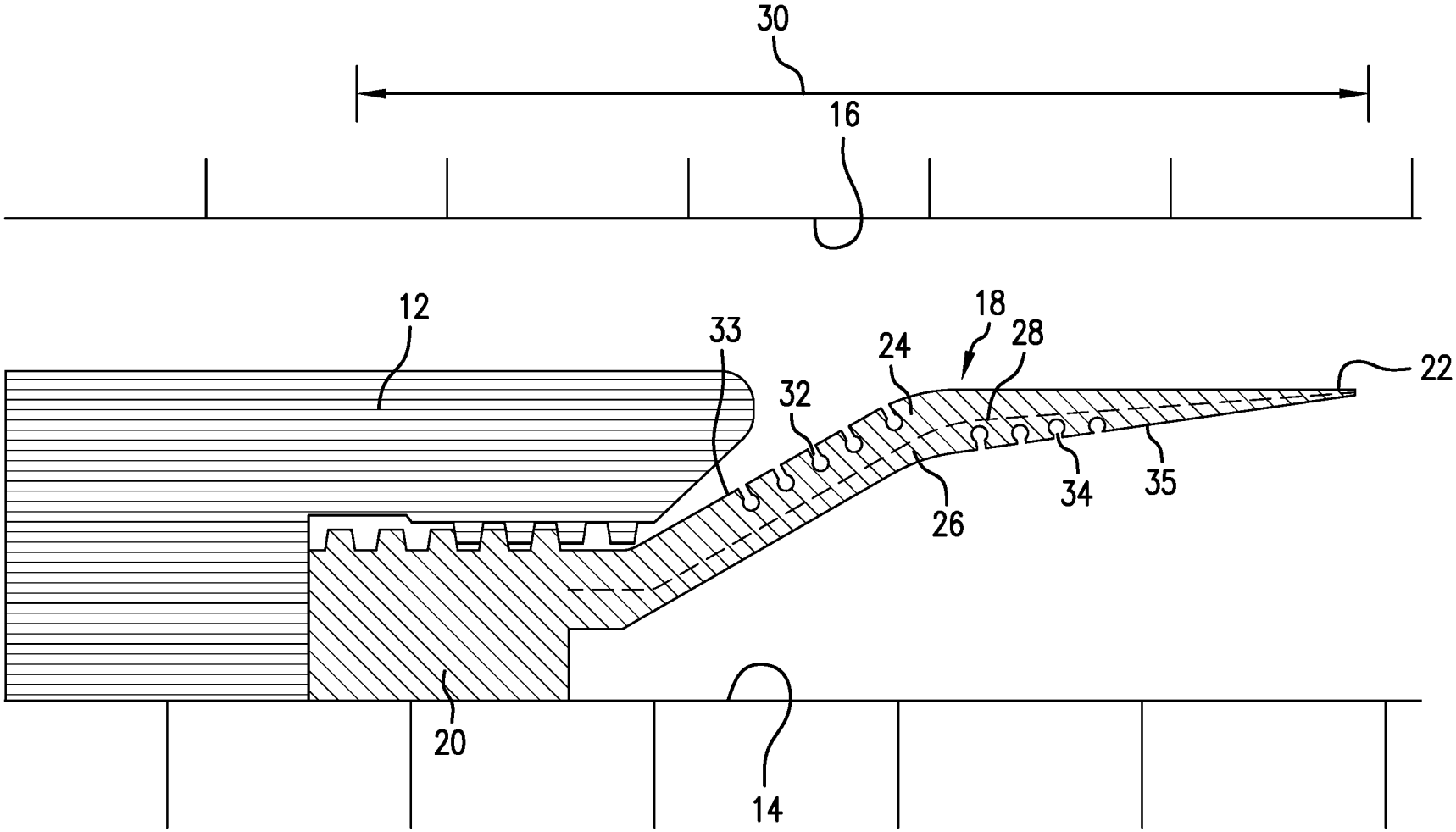
FIG. 1 is a schematic sectional view of an open tip downhole expansion tool as disclosed herein.

Referring to FIG. 1 an open tip downhole expansion tool 10 is illustrated adjacent a gauge ring 12 on a mandrel 14 and within a tubular 16 in which the tool 10 is to be set. The tool 10 as disclosed comprises a frustoconical member 18 whose structure demands only a relatively low pressure to set and yet provides a high resistance to failure through plastic deformation. The frustoconical member 18 includes a base 20 extending to an open tip 22 wherein the base presents a diametrically smaller structure than the tip 22. Frustoconical member 18 further features a radially outer zone 24 and a radially inner zone 26 that are delineated for illustrative purposes by a dashed line 28 along the member 18. It is to be understood that although, in FIG. 1, the dashed line 28 roughly partitions the member 18 to be ½ outer zone 24 and ½ inner zone 26, it is contemplated that the radially inner zone 26 may be smaller or larger or the radially outer zone 24 may be smaller or larger including the inner or outer zone being ¼ of the thickness of the material of the member 18 and the other of the radially inner or radially outer zone being ¾ of the thickness of the material of the member 18, for example. Further, the radially inner and radially outer zones need not together represent the entirety of the material thickness of the member 18. Rather, in embodiments, there may also be one or more other zones through the thickness of the material; the radially inner and radially outer zone merely forming a portion of the whole. The frustoconical member 18 also presents an axial length 30 extending from the base to the base 20 to the tip 22.

An outer void 32 is placed in the material of the member along a length of the radially outer zone 24. The void 32 may be in the form of a groove extending into the material from a surface 33 of the member 18 or a chamber within the material of the member 18. The grooves may be oriented to extend perpendicularly from surface 33 or at other angles therefrom. Further, while in some embodiments the grooves are oriented orthogonally to the member axis, they may also be oriented helically to the member axis. The depth of the void 32, width of the void 32, as well as the number of voids 32 are adjustable parameters. Generally, improved performance is associated with increased void count and decreased void dimension in the direction of the frustoconical member axis. Depth of the void 34 is related to overall member compliance with greater depth being proportional to greater compliance. In FIG. 1, the voids 32 are illustrated as a number of grooves. The number of grooves illustrated is 5 but more or fewer are contemplated. It is to be appreciated that in the embodiment of FIG. 1, the voids 32 extend from the outside surface 33 of the member 18 and into (and in some cases through) the radially outer zone 24 of the member 18. The voids 32 are positioned to be where the member 18 will make contact with the gauge ring 12 or some other structure in the various embodiments. It is further to be appreciated that other embodiments do not employ a gauge ring or similar at all but rather the voids 32(and/or 34) still facilitate deflection in a desired way and then once deflection closes the voids 32/34, the member strength increases. In embodiments like that shown where a gauge ring 12 is employed, the voids 32 maximize flexibility of the member 18 about the gauge ring 12 when setting. During the setting process, the grooves 32 will close and resistance to further bending of the member 18 dramatically increases. The increase in bending resistance is valuable for containing higher element pressures that may be experienced after the setting process.

Similar to the voids 32, an inner void 34 is also disclosed. The inner void is placed in the material of the member 18 along a length of the radially inner zone 26. The void 34 may be in the form of a groove extending into the material of the member 18 from a surface 35 of the member 18 or a chamber within the material of the member 18. The depth of the void 34, width of the void 34, as well as the number of voids 34 are adjustable parameters. Generally, improved performance is associated with increased void count and decreased void dimension in the direction of the frustoconical member axis. Depth of the void 34 is related to overall member compliance with greater depth being proportional to greater compliance. In FIG. 1, the voids 34 are illustrated as a number of grooves. The number of grooves illustrated is 4 but more or fewer are contemplated. It is to be appreciated that in the embodiment of FIG. 1, the voids 34 extend from the inside surface 35 of the member 18 and into (and in some cases through) the radially inner zone 24 of the member 18. The voids 34 are positioned as illustrated to be where the member 18 will need to bend in a direction to accommodate the tip 22 contacting an inside dimension of a tubular in which the tool is set. In some embodiments where a sealing element is employed, this maximizes flexibility of the member 18 about the element when setting. During the setting process, the grooves 32 will close and resistance to further bending of the member 18 dramatically increases. The increase in bending resistance is valuable for containing for example, higher element pressures that may be experienced after the setting process.

In other embodiments, voids 32 or 34 configured as chambers may be circular, elongated (where the long dimension is oriented axially, radially or any other angulation relative to the member axis), or as a result of a patterned structure, such as honeycomb or lattice structure, etc. In each case, the collapse of the voids 32 and/or 34 will result in the increased deflection resistance but prior to full collapse of the voids 32/34, a reduced resistance to deflection is achieved.

Figure 4:
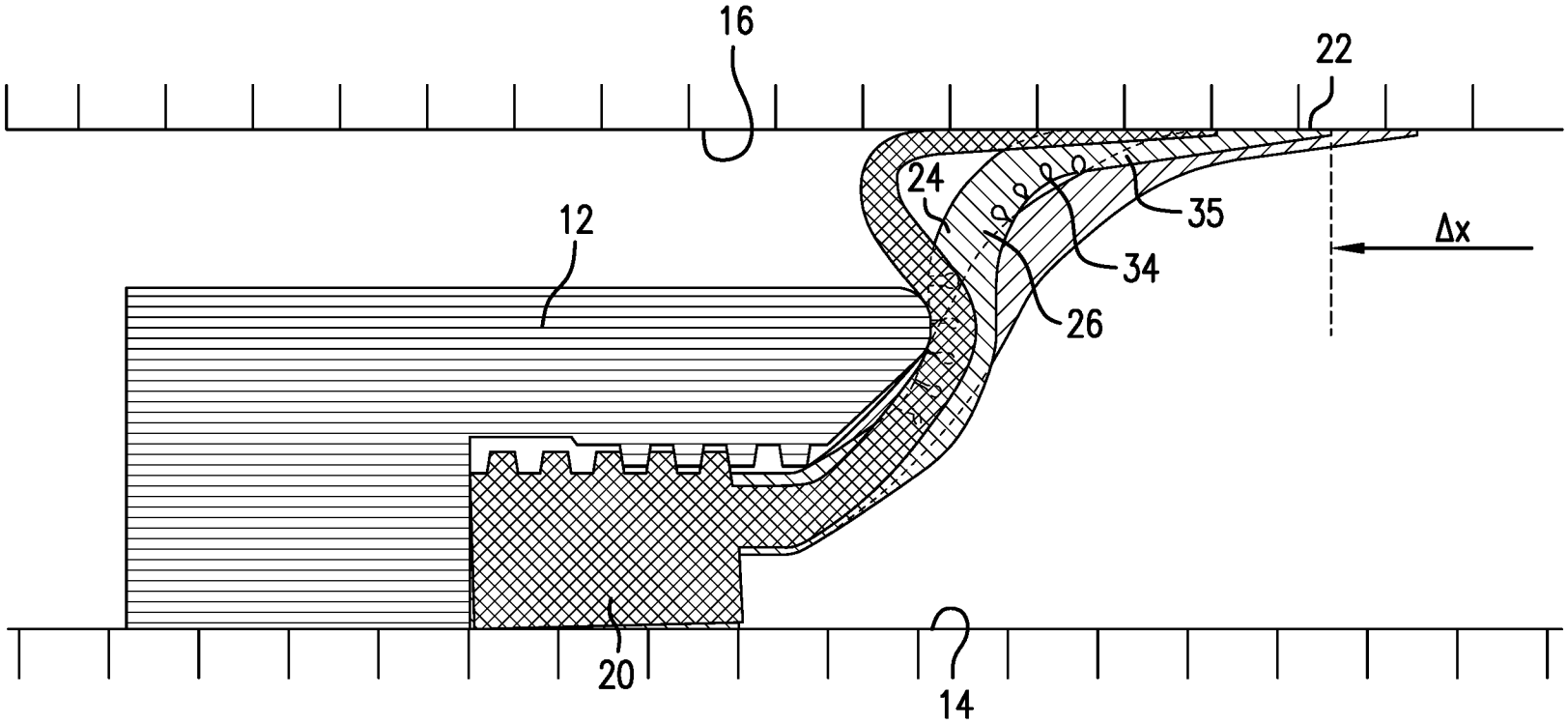
FIG. 4 is a schematic view of all three above tools overlays and in a set position.

Referring to FIG. 4, each of a prior art open tip downhole expansion tool, a thicker open tip downhole expansion tool and the inventive open tip downhole expansion tool are overlayed to indicate the relative positions they would take during a setting process and at the same pressures. As one will appreciate, the inventive open tip downhole expansion tool is in a near perfect position while the prior art open tip downhole expansion tool is overly deformed and ready to fail and the thick open tip downhole expansion tool has failed to be fully properly set. The prior art open tip downhole expansion tool will be inadequate for higher after setting pressures and the thick open tip downhole expansion tool will require excessive setting pressures. The inventive open tip downhole expansion tool maximizes usability and reliability.

Figure 2:
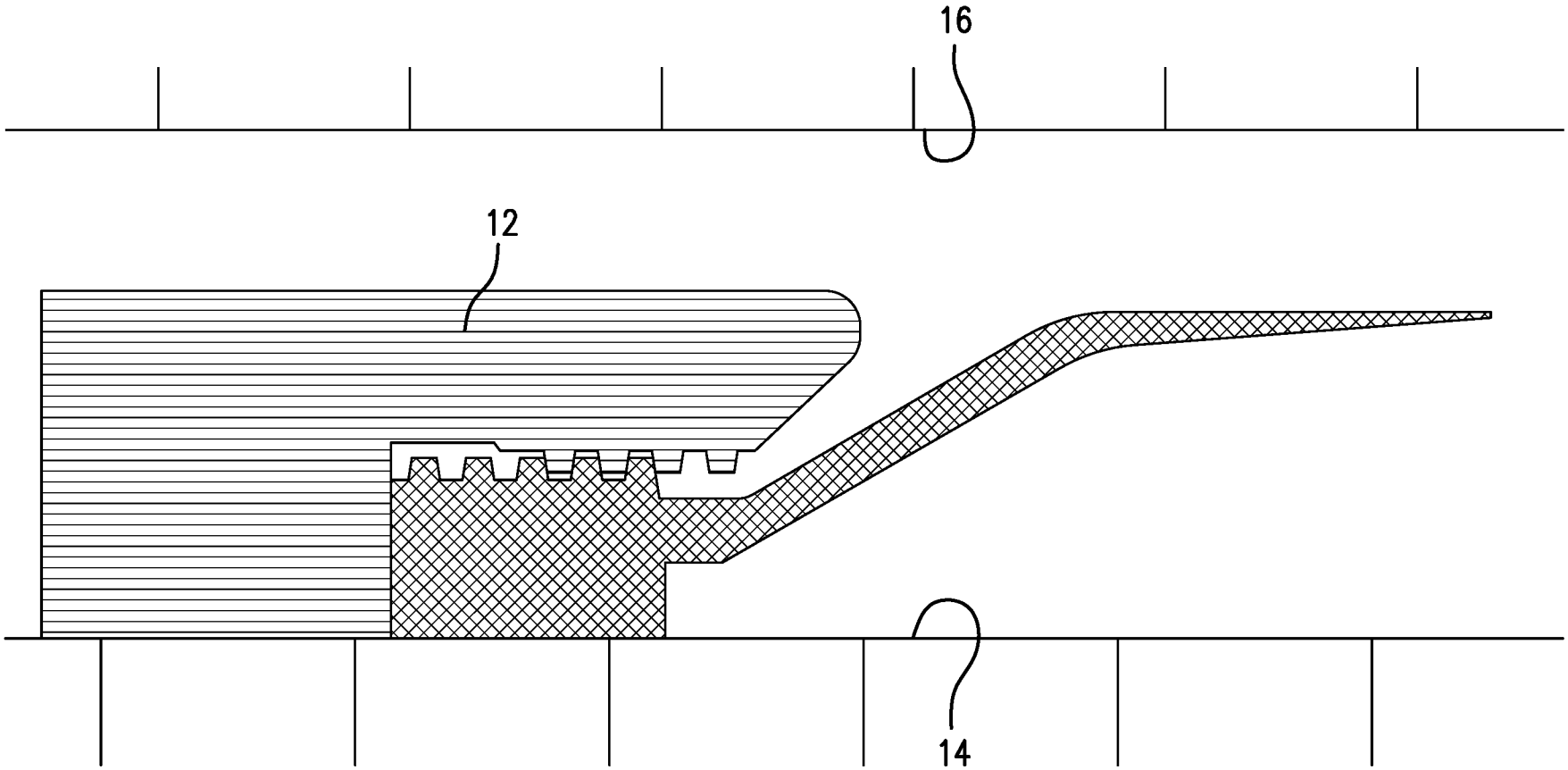
FIG. 2 (Prior Art)
FIG. 2 is a schematic sectional view of an open tip downhole expansion tool that is relatively common in the art (prior art)
Figure 3:
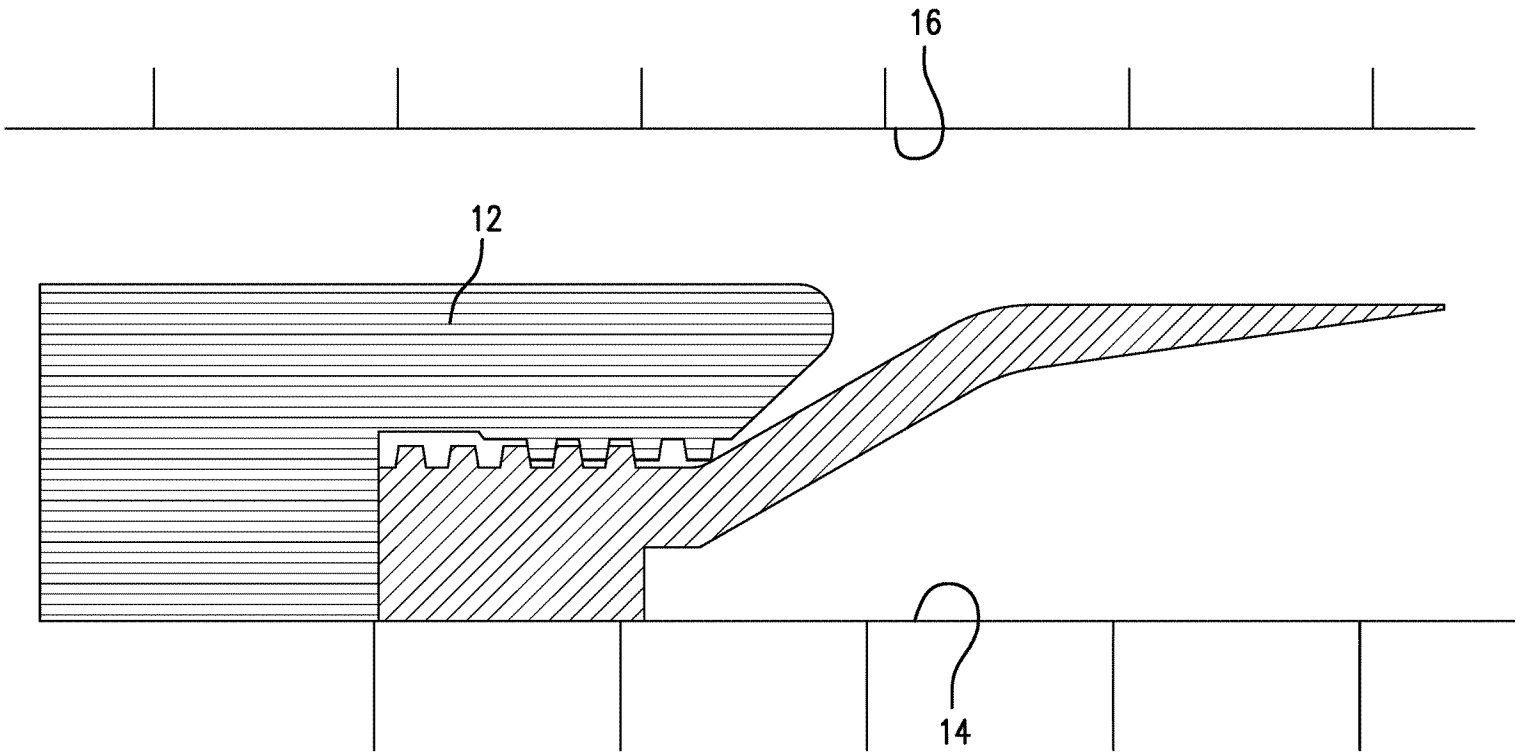
FIG. 3 is a schematic sectional view of an open tip downhole expansion tool of greater thickness than would be used in the art but presented for comparison with characteristics of the tool disclosed herein.
Figure 5:
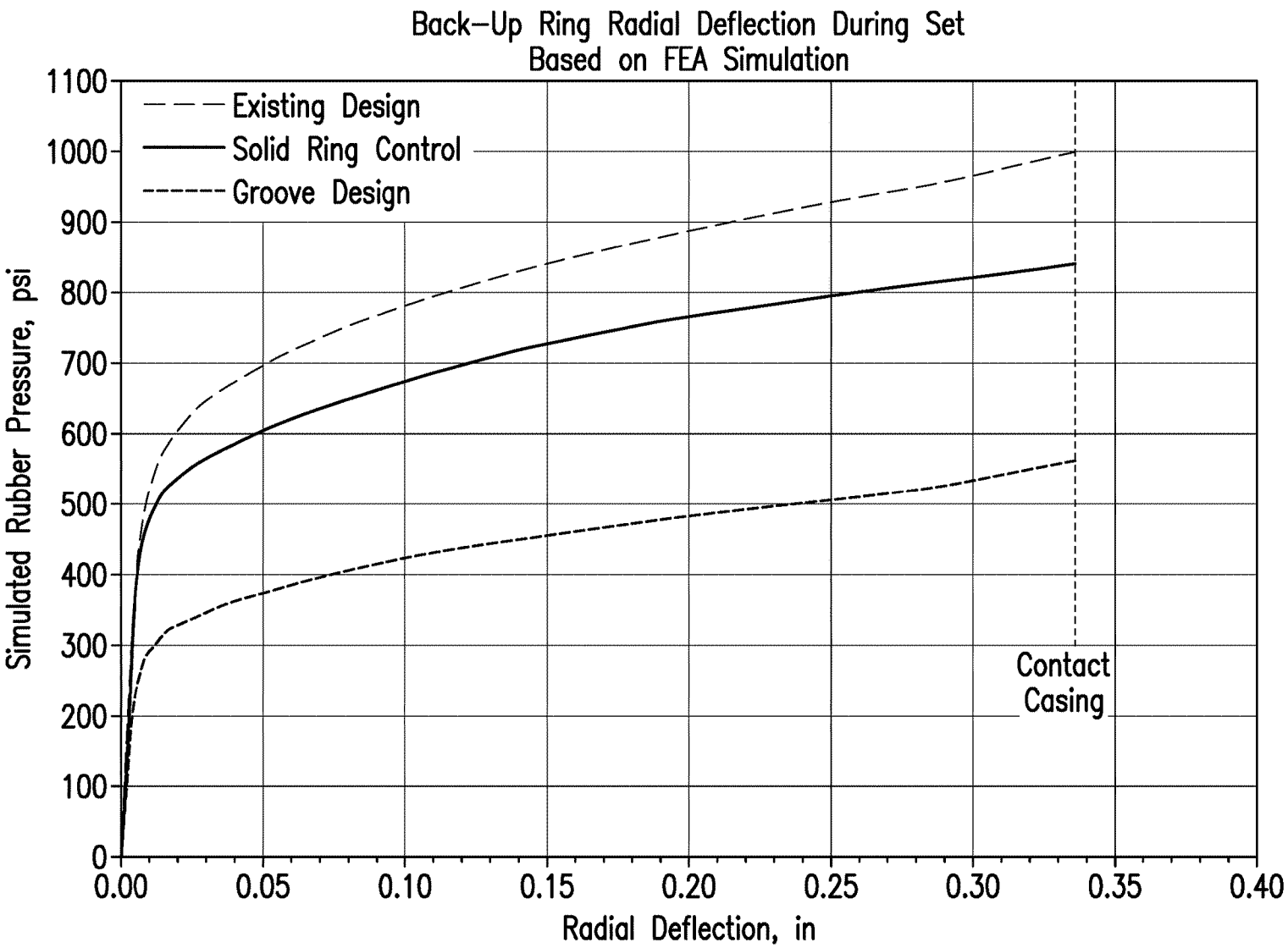
FIG. 5 is a graph of rubber pressure versus radial deflection of each of the open tip downhole expansion tools of FIGS. 1-3 used in a capacity as a seal element backup ring.
Figure 6:
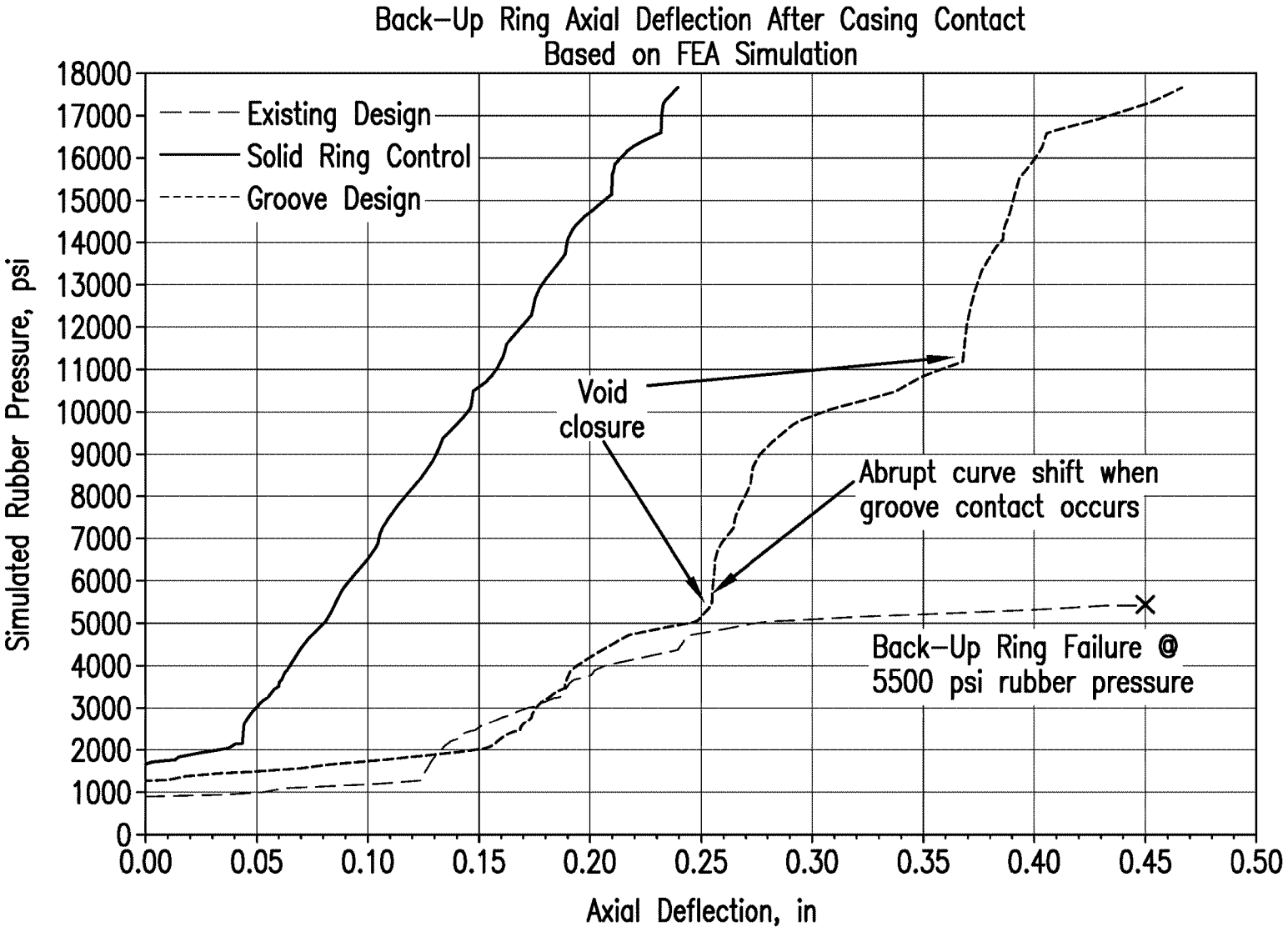
FIG. 6 is a graph plotting rubber pressure versus axial deflection of each of the open tip downhole expansion tools of FIGS. 1-3 used in a capacity as a seal element backup ring after casing contact has occurred.

With regard to the above assertion that resistance to deformation increases dramatically with voids closing, the graphs identified as FIGS. 5 and 6 convey rubber pressure versus radial deflection of each of the open tip downhole expansion tools of FIGS. 1-3 used in a capacity as a seal element backup ring and rubber pressure versus axial deflection of each of the open tip downhole expansion tools of FIGS. 1-3 used in a capacity as a seal element backup ring after casing contact has occurred, respectively. It is readily apparent from these graphs that the inventive open tip downhole expansion tool performs significantly better than the others depicted. Similar benefits are reaped by using the inventive open tip downhole expansion tool for duties other than as a seal element backup ring. Considering FIG. 6, it is highlighted that each of the step changes in the plot of the herein disclosed open tip downhole expansion tool are associated with void closure.

Set forth below are some embodiments of the foregoing disclosure:

Embodiment 1: An open tip downhole expansion tool including a frustoconical member having a base at a diametrically smaller portion of the frustoconical member and a tip at a diametrically larger portion of the frustoconical member, the member having a radially outer zone and a radially inner zone and having an axial length extending from the base to the tip; an outer void in a material of the member along a length of the radially outer zone; and an inner void in a material of the member along a length of the radially inner zone, the outer and inner voids being located at different positions along the axial length of the frustoconical member, the outer and inner voids each causing the frustoconical member to present a first resistance to deformation when the voids are open and a higher resistance to deformation of the frustoconical member when the voids are collapsed.

Embodiment 2: The tool as in any prior embodiment, wherein at least one of the radially inner zone and radially outer zone is about ½ a radial thickness of a material of the frustoconical member.

Embodiment 3: The tool as in any prior embodiment, wherein one of the radially inner zone and radially outer zone is about ¼ of a radial thickness of a material of the frustoconical member.

Embodiment 4: The tool as in any prior embodiment, wherein at least one of the outer void and the inner void is a groove.

Embodiment 5: The tool as in any prior embodiment, wherein at least one of the outer void and the inner void is a chamber.

Embodiment 6: The tool as in any prior embodiment, wherein the is a groove extends from an outer or inner radial surface respectively of the frustoconical member to a depth of between about ¼ and about ¾ of a radial thickness of a material of the frustoconical member.

Embodiment 7: The tool as in any prior embodiment, wherein a collapsed void is one in which opposing side walls of the void come into contact with each other.

Embodiment 8: The tool as in any prior embodiment, wherein at least one of the inner void and the outer void is a plurality of voids.

Embodiment 9: The tool as in any prior embodiment, wherein the plurality of voids is a group of parallel grooves extending from a surface of the member into the material of the member.

Embodiment 10: The tool as in any prior embodiment, wherein the groove further includes a rounded end for stress riser reduction.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An open tip downhole expansion tool comprising:

a frustoconical member having a base at a diametrically smaller portion of the frustoconical member and a tip at a diametrically larger portion of the frustoconical member, the member having a radially outer zone and a radially inner zone and having an axial length extending from the base to the tip;

an outer void in a material of the member along a length of the radially outer zone and extending from a radially outer surface of the frustoconical member into the radially outer zone; and an inner void in a material of the member a long a length of the radially inner zone and extending from a radially inner surface of the frustoconical member into the radially inner zone, the outer and inner voids being configured to collapse when the frustoconical member is expanded and located at different positions along the axial length of the frustoconical member, the outer and inner voids each causing the frustoconical member to present a first resistance to deformation when the voids are open and a higher resistance to deformation of the frustoconical member when the voids are collapsed.

2. The tool as claimed in claim 1 wherein at least one of the radially inner zone and radially outer zone is about ½ a radial thickness of a material of the frustoconical member.

3. The tool as claimed in claim 1 wherein one of the radially inner zone and radially outer zone is about ¼ of a radial thickness of a material of the frustoconical member.

4. The tool as claimed in claim 1 wherein at least one of the outer void and the inner void is a groove.

5. The tool as claimed in claim 1 wherein at least one of the outer void and the inner void is a chamber.

6. The tool as claimed in claim 3 wherein at least one of the outer void or the inner void is a groove which extends from the radially outer or inner surface respectively of the frustoconical member to a depth of between about ¼ and about ¾ of a radial thickness of a material of the frustoconical member.

7. The tool as claimed in claim 1 wherein a collapsed void is one in which opposing side walls of the void come into contact with each other.

8. The tool as claimed in claim 1 wherein at least one of the inner void and the outer void is a plurality of voids.

9. The tool as claimed in claim 8 wherein the plurality of voids is a group of parallel grooves extending from a surface of the member into the material of the member.

10. The tool as claimed in claim 4 wherein the groove further includes a rounded end for stress riser reduction.

* * * * *